United States Patent [19]

Allen

[11] 4,220,207

[45] Sep. 2, 1980

[54] SEAFLOOR DIVERTER

[75] Inventor: Neil W. Allen, Powell, Wyo.

[73] Assignee: Standard Oil Company (Indiana), Chicago, Ill.

[21] Appl. No.: 956,320

[22] Filed: Oct. 31, 1978

[51] Int. Cl.[2] ..... E21B 7/12

[52] U.S. Cl. ..... 166/367; 166/362; 175/7; 175/206; 166/357

[58] Field of Search ..... 166/367, 368, 356, 350, 166/359, 355, 357, 362; 175/7, 25, 38, 207, 209, 210, 214, 206

[56] References Cited

U.S. PATENT DOCUMENTS

| | | | |
|---|---|---|---|
| Re. 28,978 | 9/1976 | Brooks | 166/359 |
| 3,434,550 | 3/1969 | Townsend, Jr. | 175/5 |
| 3,603,409 | 9/1971 | Watkins | 175/7 |
| 3,656,549 | 4/1972 | Holbert et al. | 166/356 |
| 3,857,255 | 12/1974 | Elwood et al. | 166/368 X |
| 3,885,623 | 5/1975 | Watkins et al. | 166/368 X |
| 4,040,264 | 8/1977 | Neilon | 175/7 |
| 4,046,191 | 9/1977 | Neath | 166/75 R |
| 4,059,148 | 11/1977 | Blomsma | 175/7 X |
| 4,063,602 | 12/1977 | Howell | 175/7 |
| 4,099,582 | 7/1978 | Bell | 175/5 |
| 4,134,461 | 1/1979 | Blomsma | 166/335 X |
| 4,149,603 | 4/1979 | Arnold | 175/7 |

*Primary Examiner*—Ernest R. Purser
*Assistant Examiner*—Richard E. Favreau
*Attorney, Agent, or Firm*—John D. Gassett

[57] ABSTRACT

This relates to drilling in water from a platform or vessel using a riser pipe. An inverted funnel skirt or cone is placed over slots cut in the wall of a riser pipe a short distance above its lower end. The apex end of the cone is welded to the riser pipe above the slots and drill cuttings pass through the slots and fall to the seafloor. Another embodiment includes an "L" shaped diverter flowline welded to the periphery of each hole in the riser pipe with one leg of the "L" extending a short distance below the hole.

7 Claims, 8 Drawing Figures

SEAFLOOR DIVERTER

BRIEF SUMMARY OF THE INVENTION

This invention concerns drilling wells in seafloors from floating vessels in which a large diameter pipe, commonly called a "riser pipe," connects a floating vessel to a subsea wellhead. The wellhead is connected to multiple concentric casing strings cemented in a hole drilled in the seafloor. The drill string and drill bit are run through the riser pipe and a heavy drilling fluid, commonly called "drilling mud, " is circulated down through the hollow drill string, through the drill bit where it picks up cuttings and carries them to the surface through the annulus between the drill pipe and the riser pipe. In some drilling areas, the exposed formations below the last set casing string are too weak to support a full column of drilling mud and/or withstand the forces generated during a gas flow in event gas is encountered in the exposed formations. An apparatus, which is called a "seafloor diverter," is disclosed for drilling in such situations.

In one embodiment, the seafloor diverter includes a section of marine riser pipe into which several slots have been cut in the wall a short distance above its lower end. The slot size is directly related to the internal flow area of the riser pipe. A diverter skirt, which can be an inverted funnel or cone, is placed over these slots. The apex end of the cone is welded to the riser pipe above the slots and the lower end or base section of the cone is lower than the lowermost part of the slots. During drilling operations, drilling returns rise in the annulus between the drill pipe and the riser pipe, and the drilling cuttings being heavier than the sea water will reach an equilibrium height in the annulus. Then all subsequent mud returns, that is, the cuttings, will pass through the diverter slot and fall to the seafloor.

Another embodiment of the invention omits the diverter skirt and uses a riser pipe provided with holes; an "L" shaped diverter flowline is welded to the periphery of each hole and the long leg of the "L" extends below the slot a selected distance. Operations of the second embodiment are similar to those of the first.

DRAWINGS

DETAILED DESCRIPTION

Figure 1:
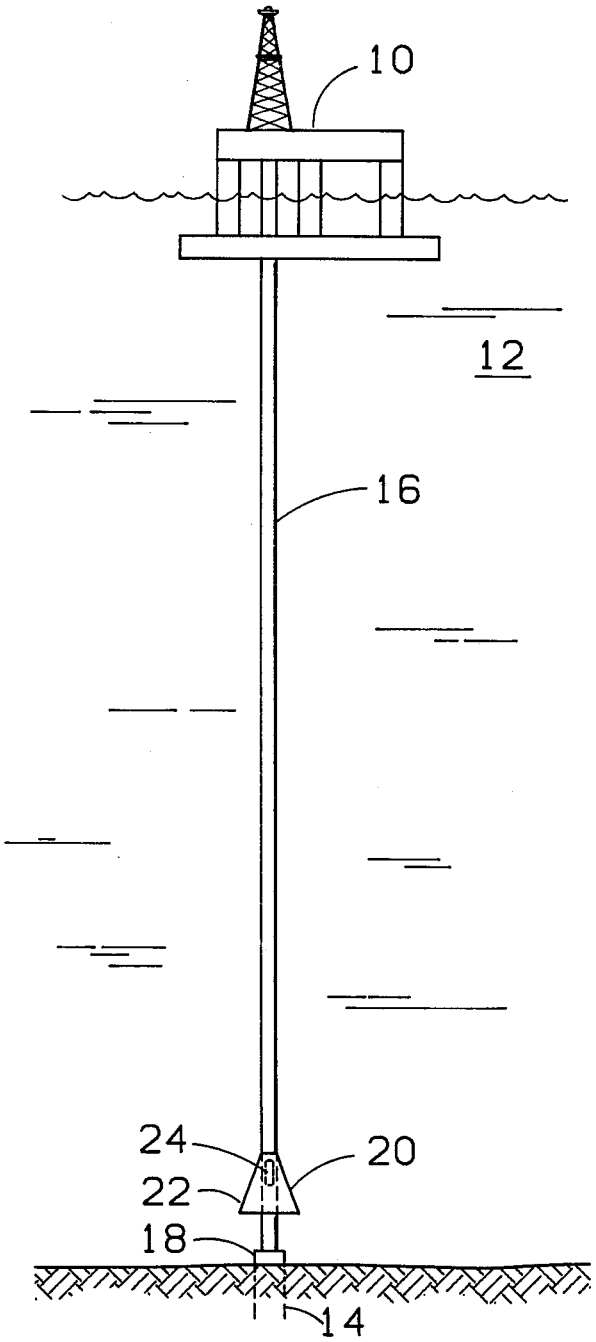
FIG. 1 illustrates a floating drilling vessel with riser pipe utilizing the seafloor diverter of this invention.

Attention is first directed to FIG. 1 which illustrates a drilling vessel 10 floating on a body of water 12 and connected to a subsea well 14 by a marine riser pipe 16 through a seafloor connector 18. Riser pipe 16 is different from the conventional riser pipe in that it includes a seafloor diverter 20 located just above the seafloor connector 18. The seafloor diverter includes a skirt 22 surrounding ports or slots 24 in the wall of the riser pipe 16. The upper end or apex end of skirt 22 is sealed, such as by welding, to the external wall of the marine riser pipe. The lower end or base end of the skirt 22 is lower than the lowermost part of the slots 24. The bottom of the skirt 22 should extend below slots 24 a sufficient distance to provide a backpressure or resistance to gas flow through the slots 24 when the riser pipe 16 is at an angle with the vertical. The slots 24 should be high enough above the seafloor connector 18 to provide for drilling solids buildup around the wellhead without plugging slots 24.

Figure 2:
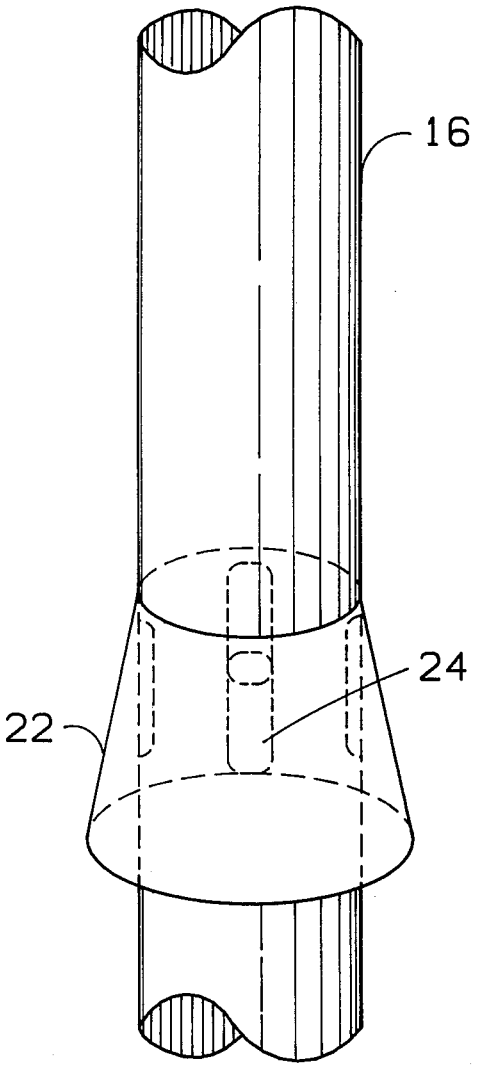
FIG. 2 illustrates an enlargement of the seafloor diverter of FIG. 1.

Attention is next directed to FIG. 2 which shows an enlarged view of the seafloor diverter of FIG. 1. Shown thereon are the four vertical slots 24 spaced 90 degrees apart. There can be any number of diverter slots as may be desired; however, four is normally the appropriate number. The area of slots 24 is equal to or greater than the upward cross-sectional flow area within riser pipe 16. There will be a drill pipe within riser pipe 16 during drilling operations and the upward flow area, then, is the area of the annulus between the drill pipe and the interior wall of riser pipe 16.

Figure 3:
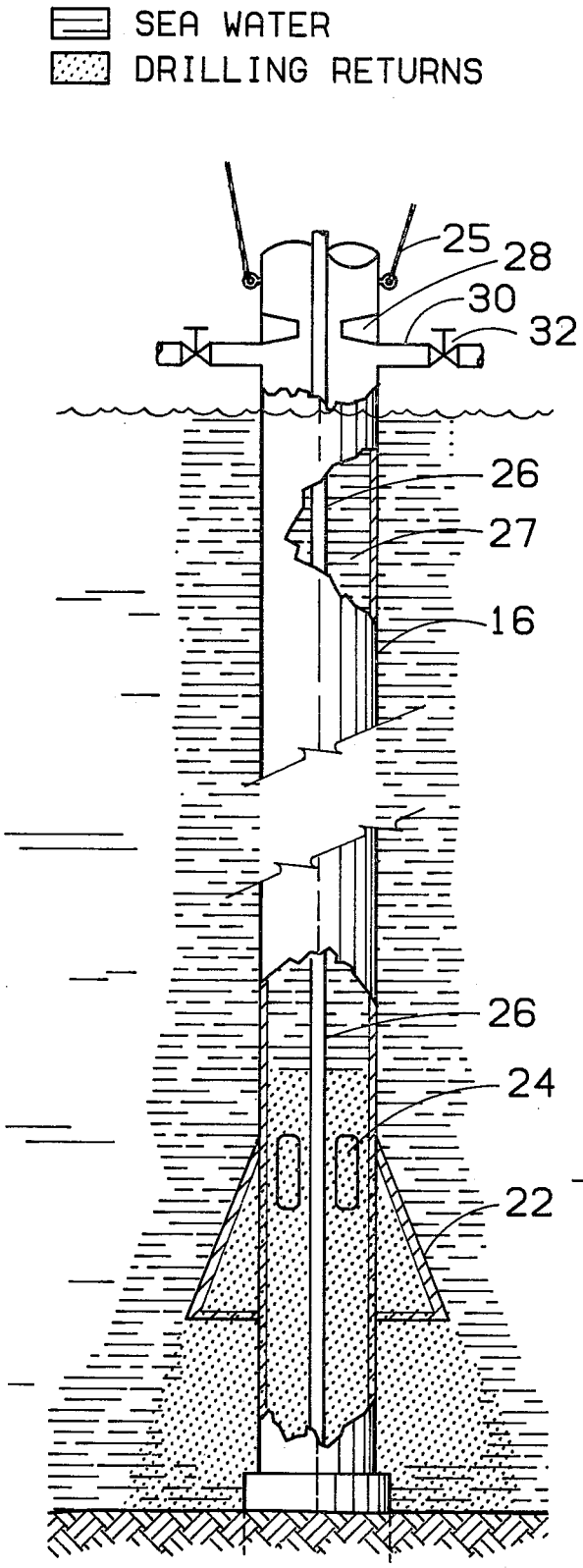
FIG. 3 illustrates the seafloor diverter in operation during the drilling phase.

Attention is next directed to FIG. 3 which illustrates the diverter in operation during the drilling phase of the operation. The riser pipe 16 is supported at the surface from vessel 10 by lines 25. A drill string 26 is suspended in riser pipe 16 and extends to a drill bit, not shown, which is used for drilling the hole deeper. Also shown at the upper end of riser pipe 16 are diverter lines 30 with valves 32. Also shown at the upper end of riser pipe 16 is a diverter bag 28 which is shown as open. The diverter bag 28 is capable of being actuated to seal against drill pipe 26 to effectively seal the upper end of the riser pipe 16. An example of a suitable diverter bag is the Regan Offshore International, Inc., Type KFD. In normal drilling operations, a drilling fluid or drilling mud is circulated down the drill pipe 26 through the bit at the bottom where it picks up cuttings and returns the cuttings up the annulus 27 between the riser pipe 16 and the outer wall of the drill pipe 26. These drilling returns rise in the annulus 27 at a rate determined by the mud pumps which force the drilling fluid down the drill pipe 26. The device of FIG. 3 shows the operations prior to encountering any gas in the subsurface formations. The drilling fluid and drilling cuttings being heavier than the sea water will reach an equilibrium height in annulus 27. Thus, all subsequent drilling fluid returns (drill bit cuttings) will pass through the diverter slots 24 and fall to the seafloor. During this time, the surface diverter bag 28 and diverter line valves 32 are open.

Figure 4:
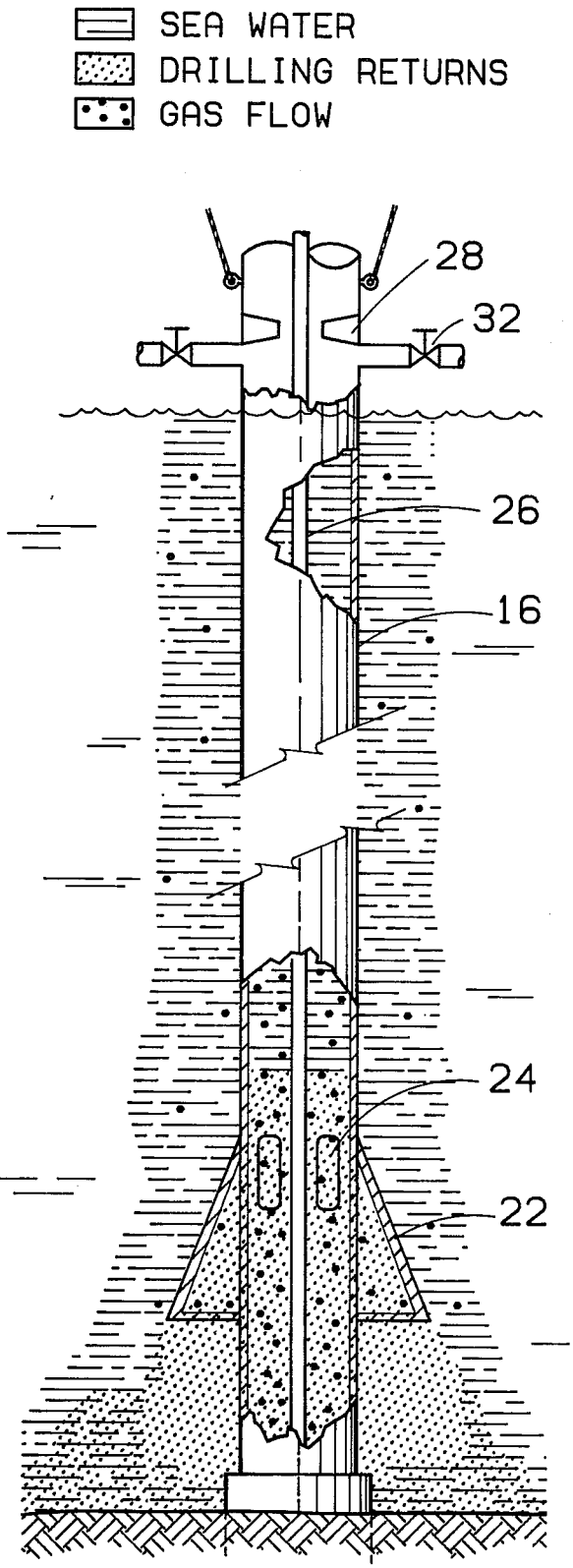
FIG. 4 is similar to FIG. 3 except it illustrates the tool function during the initial stages of a gas flow.

Attention is next directed to FIG. 4 which illustrates the seafloor diverter's function during the initial stages of the gas flow. The situation shown assumes that the gas flow is of sufficient magnitude as to at least partially unload the riser 16 of the sea water and drilling mud. Until gas is encountered by drilling, the fluid within riser 16 above diverter slots 24 forms a stationary mass. The interaction of a moving mass (gas) and a stationary mass (sea water and drilling mud) creates a backpressure which impedes the gas flow. This backpressure is relieved through the diverter slots 24 and is not imposed on the weak formations that are exposed below the last set casing string. It is from these weak formations which the gas is being produced. As shown in FIG. 4, it is envisioned that initially a small quantity of gas could be released through the slots 24 to the sea water external of the riser 16; however, the diverter skirt 22 is designed to keep the gas released to a minimum.

Figure 5:
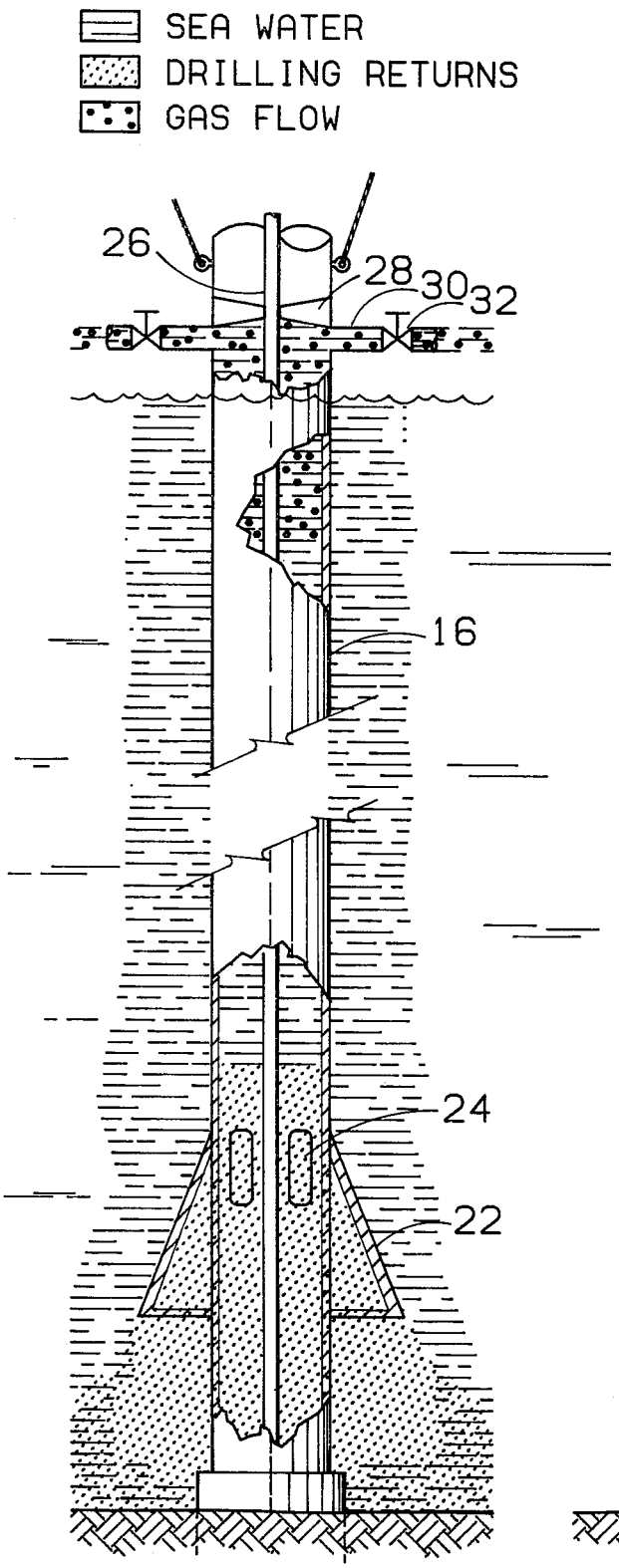
FIG. 5 is similar to FIG. 4 except it illustrates the flow conditions after a period of time.

Most of the gas flowing up through the riser pipe will be contained in the riser pipe and will not escape to the exterior. By way of explanation, gas flowing through the slots 24 has to travel downward the vertical distance that the skirt 22 extends pass slots 24. This forces the gas to flow in a direction of incrasing pressure. In addition, the gas, being much less dense than the sea water, has a strong vertical force which resists any downward movement. These two factors combine to create a pressure situation which opposes gas flow through the slots 24. As long as pressures generated within the riser 16 are less than the sum of the sea water hydrostatic head and the skirt 22 induced backpressure, all gas flow will be contained within the marine riser 16. This condition should exist once the initial shock created by the moving gas encountering a stationary water mass has subsided. The upward force generated by the gas will initiate upward movement of the fluid in the riser 16. This movement will decrease the internal pressure within the riser 16 such that all gas flow will be contained within the riser 16. As the pressure is reduced within the riser 16 by the upward movement of the gas and water, water will be pulled into the riser 16 through slots 24 from the surrounding sea water mass. The net effect of this sea water encroachment will be to present a dampening force on the gas flow and not permit the riser to be blown dry. This also permits a non-combustible mixture of gas and water to be discharged through the diverter lines 30. It is to be noted in FIG. 5 that flow diverter 28 has been actuated to be in a closed position against the drill pipe 26. Diverter line valves 32 are open; thus, all gas will escape through the diverter lines 30 where it can be dissipated away from the rig.

Figure 6:
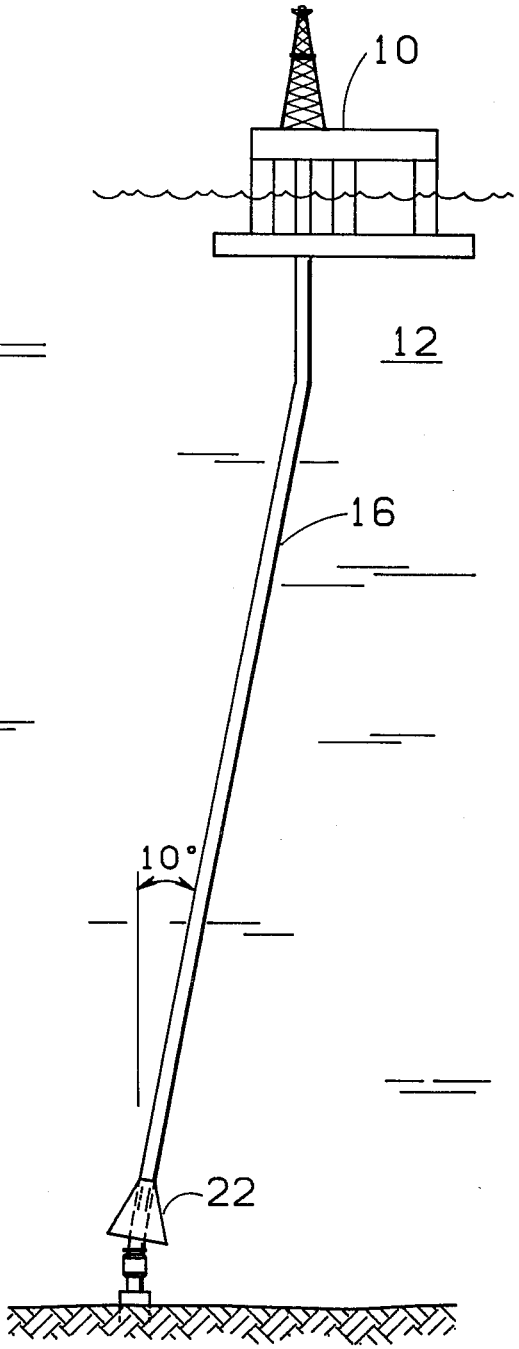
FIG. 6 is similar to FIG. 1 except it shows the riser pipe at an angle with the vertical.

Attention is next directed to FIG. 6. In a marine drilling operation, the floating drilling vessel 10 is rarely located directly over the wellbore. This means the marine riser 16 will be inclined at an angle dependent on the magnitude of vessel 10's horizontal displacement. As shown in FIG. 6, the marine riser 16 there is depicted as being displaced 10 degrees from the vertical. This can vary from the vertical to as much as 20 or more degrees, although it is desired to keep the deviation as small as possible.

Figure 7:
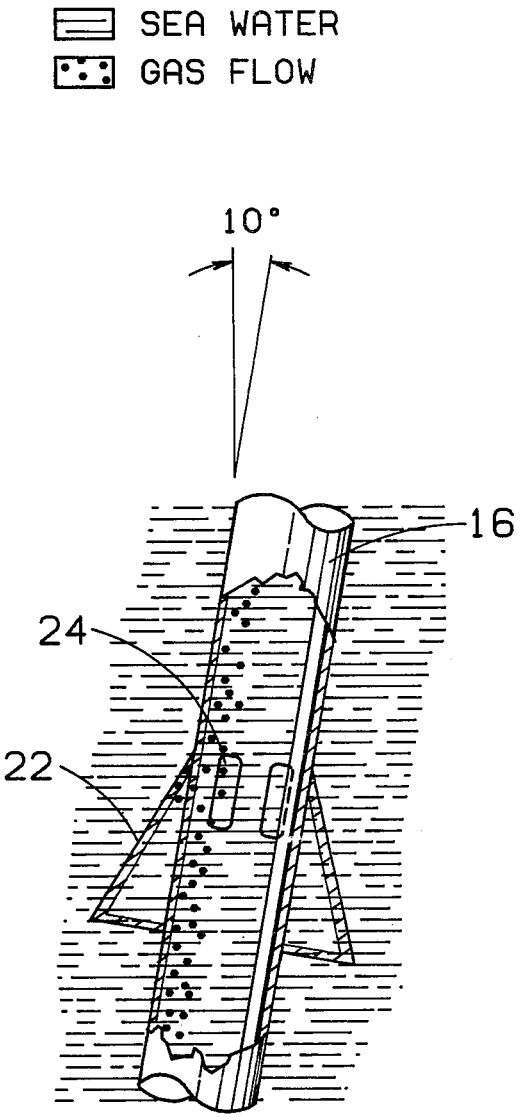
FIG. 7 is an enlargement of the diverter in the position shown in FIG. 6.

Attention is now directed to FIG. 7. In this case, the riser 16 inclination has the potential in the absence of the protective skirt 22 of exposing the diverter slots 24 such that the preferential flow of the gas above the slots would be external to the marine riser 16. The diverter skirt 22 guards against such happening for the reasons discussed above. The diverter skirt 22 must be of sufficient vertical dimension that, even though the riser pipe 16 is deviated from the vertical, the lower end of skirt 22, at its highest point due to tilting, will be below the lower part of the diverter slots 24.

Figure 8:
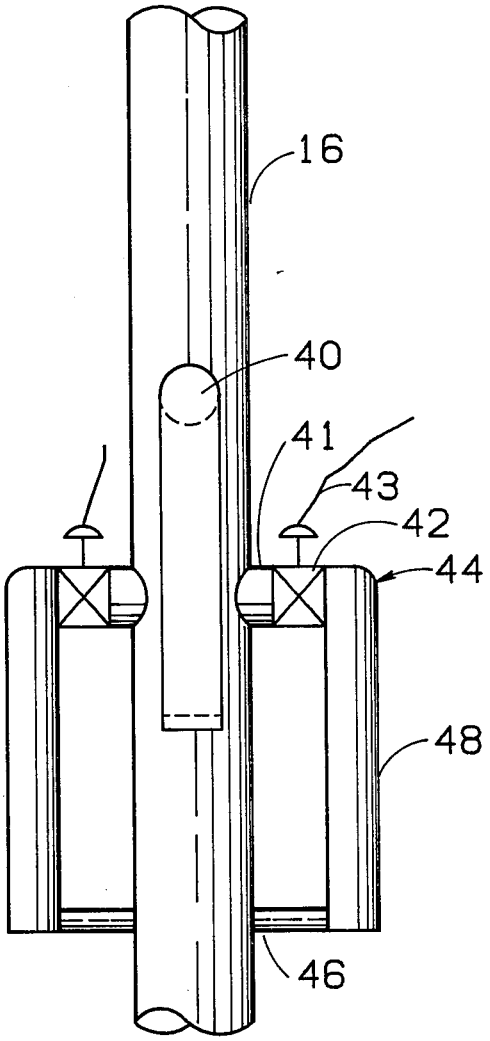
FIG. 8 illustrates another embodiment of the diverter.

A modification of the flow diverter is shown in FIG. 8. It is believed that this is the preferred embodiment of this tool. The operation principle, when applied to the embodiment of FIG. 8, is the same as above described in connection with the flow diverter shown in FIG. 2. In FIG. 8, there is shown a riser pipe 16 having a plurality of ports 40 in the walls thereof. These ports can all be at the same level or they can be staggered as shown in FIG. 8 to avoid undue weakening of riser 16. Each port 40 is provided with an "L" shaped deflector pipe 44 having a horizontal leg 41 and a vertical leg 48 which is open at the lower end. Horizontal leg 41 is provided with a valve 42 which can be remotely operated so that it can be closed or opened from the floating vessel 10 by control line 43. The end of horizontal leg 41 is welded to the periphery of port 40 to form a fluid-tight connection so that the only fluid communication between the interior of the lower portion of riser 16 and the exterior thereof is through port 40 and deflector pipe 44 when valve 42 is open. The size of each port 40 is directly related to the internal flow area of the riser pipe 16. The total area of ports 40 is equal to the internal flow area of the riser 16. In order to provide for a stable installation, the lower end of vertical leg 48 should be braced to riser pipe 16 by brace 46. The advantages of the design of the embodiment of FIG. 8 are (a) it is simple to fabricate, and (b) the ability to remotely close the deflector pipe valves 42 provides more control over any given situation and gives the tool flexibility.

While the above description has been given in detail, it is possible to provide various modifications to the embodiments described without departing from the spirit or scope of the invention.

What is claimed:

1. A seafloor diverter for use with a riser pipe extending from a subsea well through sea water to a drilling unit on the body of water which comprises:

a pipe section connectable to the lower end portion of said riser pipe and having at least one port means in the wall thereof, and a diverter means surrounding said port means and sealingly engaging said pipe section at least at the upper end of each said port means and extending down below said port means to form a flow channel from the interior of said pipe section through said port means to the environment exterior of said pipe section only at a point below said port means.

2. A seafloor diverter as defined in claim 1 in which said diverter means includes an "L" shaped conduit for each said port means, one leg of said "L" welded to the periphery of said port means, and the other leg extending downwardly to a position below said port means and opening into said sea water, and a remotely operable valve means in said "L" shaped conduit.

3. A seafloor diverter as defined in claim 1 wherein said diverter means includes a skirt means having the upper end of said skirt welded to said pipe section above said port means and the lower end of said skirt means extending outwardly and downwardly to a point below said port means.

4. A diverter as defined in claim 2 in which the area of said port means is at least as great as the flow area within said pipe section.

5. A seafloor diverter for use with a riser pipe extending from a subsea well through sea water to a drilling unit on a body of water comprising:

a section of pipe connectable to the lower end portion of said riser pipe and having a plurality of ports in the wall thereof;

an "L" shaped pipe for each port having a first leg and a second leg, said first leg welded to one of said ports, and the other leg extending along the pipe section to a point below said port and opening into said sea water.

6. A seafloor diverter as defined in claim 5 including a remotely operable valve in said "L" shaped pipe.

7. A diverter as defined in claim 5 in which the area of said ports is at least as great as the flow area within said section of pipe.

* * * * *

UNITED STATES PATENT OFFICE

CERTIFICATE OF CORRECTION

PATENT NO. : 4,220,207

DATED : September 2, 1980

INVENTOR(S) : Neil W. Allen

It is certified that error appears in the above-identified patent and that said Letters Patent are hereby corrected as shown below:

Column 4, line 36, Claim "2" should be --4--.

line 43, Claim "3" should be --2--.

line 49, Claim "4" should be --3--.

Signed and Sealed this

*Ninth* Day of *December 1980*

[SEAL]

*Attest:*

SIDNEY A. DIAMOND

*Attesting Officer*

*Commissioner of Patents and Trademarks*